US006018854A

United States Patent [19]

Miyasaka

[11] Patent Number: 6,018,854

[45] **Date of Patent: *Feb. 1, 2000**

[54] METHOD OF MAKING SURFACE-HARDENED METAL SHOT

[75] Inventor: Yoshio Miyasaka, Nagoya, Japan

[73] Assignee: Fuji Kihan Co., Ltd., Aichi, Japan

[ * ] Notice: Under 35 U.S.C. 154(b), the term of this patent shall be extended for 348 days.

[21] Appl. No.: 08/490,180

[22] Filed: Jun. 14, 1995

[30] Foreign Application Priority Data

Jun. 14, 1994 [JP] Japan ..... 6-132311

[51] Int. Cl.[7] ..... B21K 21/06

[52] U.S. Cl. ..... 29/1.22; 29/90.7; 29/899

[58] Field of Search ..... 29/1.22, 90.01, 29/90.7, 899; 72/53; 451/38, 50, 53

[56] References Cited

U.S. PATENT DOCUMENTS

| | | | |
|---|---|---|---|
| 2,758,360 | 8/1956 | Shelter | 29/899 X |
| 2,816,466 | 12/1957 | Gladfelter et al. | 29/899 X |
| 2,895,816 | 7/1959 | Cline . | |
| 4,067,240 | 1/1978 | Straub | 29/1.22 X |
| 4,209,326 | 6/1980 | Klein et al. . | |
| 4,714,622 | 12/1987 | Omori et al. | 72/53 X |

FOREIGN PATENT DOCUMENTS

| | | |
|---|---|---|
| 869 305 | 1/1953 | Germany . |
| 2 153 055 | 8/1985 | United Kingdom . |
| 2 208 392 | 3/1989 | United Kingdom . |

OTHER PUBLICATIONS

"What Makes Good Steel Shot", Charles E. Carlin, Metal Progress, pp. 82–85, Jun. 1959.

Patent Abstracts of Japan, vol. 18, No. 622 (M–1712) Nov. 28, 1994.

Patent Abstracts of Japan, vol. 17, No. 172 (M–1392) Apr. 2, 1993.

*Primary Examiner*—David P. Bryant

*Attorney, Agent, or Firm*—Wenderoth, Lind & Ponack, L.L.P.

[57] ABSTRACT

When a shot having a hardness equal to or higher than a ferrous or nonferrous metal shot material is blasted against the surface of the metal shot material at a blasting speed of 80 m/s or above, the collision causes heat to be generated only in portions of the metal shot material against which the shot has collided. The temperature is raised in the vicinity of the surface of the metal shot material. Alternatively, the metal shot material may be blasted against a metal body having a hardness at least equal to that of the temperature of the metal shot material. In either case, the temperature in the vicinity of the surface of the metal shot material is increased to or above an $A_3$ transformation temperature when the material is ferrous and is increased to or above a recrystallization temperature when the material is nonferrous. Subsequently, the metal shot material is quickly cooled. As a result, the metallurgical structure of the surface layer 20$\mu$ deep from the surface of the metal shot material is refined such that a highly hardened and tough structure is obtained. Part of the metal shot material and the shot is recovered and the recovered metal shot material and the shot are reblasted against unrecovered metal shot material and the shot, repeatedly.

22 Claims, 2 Drawing Sheets

METHOD OF MAKING SURFACE-HARDENED METAL SHOT

BACKGROUND OF THE INVENTION

1. Field of the Invention

The present invention relates to a method of making a surface-hardened metal shot wherein a shot is blasted by a blasting machine against a surface of an object to be treated or a treated metal shot material which is formed from a ferrous metal, e.g., steel, stainless steel or high-speed steel or from a nonferrous metal, e.g., aluminum, brass, copper alloy or titanium alloy so that a surface temperature of the metal shot material is raised due to heat energy generated at the time of collision, thereby hardening the surface of the metal shot by heat treatment. Furthermore, the invention relates to a method of making a surface-hardened metal shot which is formed from a powdered alloy such as a hard metal or ceramic alloy.

2. Description of the Prior Art

An ordinary heat treatment has been employed in conventional methods of making a surface-hardened metal shot. More specifically, a metal shot material is accommodated in a heat-treating furnace and the temperature in the furnace is increased to a hardening temperature of the material. Thereafter, the metal shot material is quickly cooled so that the surface of the material is hardened. For example, the metal shot material of a ferrous metal is hardened at 800° C. and thereafter, it is tempered to 200° C.

The prior art has provided an atomizing method for making a pulverized metal shot. The ordinary hardening and tempering as described above are not executed in the atomizing method. In the atomizing method, molten alloyed metal is instantaneously atomized and quickly cooled to be solidified by means of high speed liquid. For example, the molten alloyed metal is caused to flow out of a nozzle in the form of a bar. A high speed liquid is blasted obliquely with respect to the direction of flow of the metal from around the bar-shaped molten alloyed metal so as to be concentrated at a point on the bar-shaped metal. The high speed liquid is concentrated at the point and is simultaneously atomized. The molten alloyed metal is also atomized and quickly cooled instantaneously to be solidified, whereby the pulverized metal shot is made.

In the case of the ferrous metal shot material having a grain diameter of 0.3 mm or smaller, such as steel, stainless steel or high-speed steel, the metal shot materials are adhered together when treated by the above-described ordinary hardening and tempering. Consequently, the surface of the metal shot material cannot be hardened by the ordinary heat treatment.

For the purpose of preventing the adhesion of the metal shot materials, the ferrous metal shot materials having a grain diameter of 0.3 mm or smaller are mixed with those having a larger grain diameter and then, the mixture is hardened and tempered. For example, when the ferrous metal shot materials having a grain diameter of 0.3 mm and those having the grain diameter of 0.4 mm are mixed, the heat treatment is based on the ferrous metal shot materials having the grain diameter of 0.4 mm. Consequently, the hardness of the materials having the grain diameter of 0.3 mm or smaller cannot be sufficiently increased. Furthermore, in the case of the nonferrous metal shot material having a grain diameter ranging from 0.2 to 0.4 mm, such as aluminum, brass, copper alloy or titanium alloy, the metal shot material cannot be surface-hardened by the ordinary heat treatment for the same reason as in the ferrous metal shot material.

The prior art has provided another method in which shot formed of cut wire is heat-treated before the processing. More specifically, after having been hardened by ordinary surface heat treatment, a metal wire is cut into pieces each having a length approximately equal to the grain diameter of a desired metal shot. The resulting cylindrical pieces of metal are blasted against a metal plate having a high hardness, e.g., a carbon tool steel, by an impeller of a centrifugal blasting machine. Resulting mechanical shock rounds corners of the cylindrical pieces of wire, whereby shot is obtained. The corners of the cylindrical pieces of metal wire can be rounded when its diameter is 0.4 mm or greater. However, when the diameter of the cylindrical pieces of metal wire is less than 0.4 mm, the adhesion speed thereof is reduced and accordingly, the corners cannot be rounded.

The metal wire which is to be formed into the shot can be heat-treated when its diameter is 0.25 mm or greater. However, the heat treatment cannot be performed when the diameter of the metal wire is less than 0.25 mm. Furthermore, the metal wire needs to be cut into smaller pieces as the diameter of the metal wire becomes small. The cutting becomes more difficult as the hardness of the metal wire is increased. This poses a problem of increase in the manufacturing cost. Additionally, after the metal wire is cut into pieces, each piece needs to be hardened and tempered again. The metal shot materials are adhered together in the case of the cut pieces of wire shot having a small diameter for the same reason as described above. Consequently, the hardness of the shot cannot be increased. The cut-wire shot having a grain diameter of 0.3 mm or smaller has not been used for the foregoing reasons.

SUMMARY OF THE INVENTION

Therefore, an object of the present invention is to provide a method of making a surface-hardened metal shot in which the surface hardness of the metal shot material and particularly, of the metal shot having a small grain diameter, can be increased so that durability of the shot can be improved.

To achieve the above-described and other objects, the present invention provides a method of making a surface-hardened metal shot, comprising the steps of accommodating a predetermined quantity of shot in a first container of a blasting machine, accommodating a predetermined quantity of metal shot material in a second container of the blasting machine, the shot having a hardness equal to or higher than that of the metal shot material, and blasting the shot against a surface of the metal shot material under such conditions, e.g. at a blasting speed of 80 m/s or above, that the temperature of the metal shot material in the vicinity of the surface thereof is increased to or above an $A_3$ transformation temperature thereof when the metal shot material is ferrous or to or above a recrystallization temperature thereof when the metal shot material is nonferrous. Each of the metal shot material and the shot may have a grain diameter of 0.3 mm or smaller.

When the shot having a hardness equal to or higher than that of the metal shot material is blasted against the surface of the ferrous or nonferrous metal shot material at a sufficient speed, the temperature of the ferrous metal shot material in the vicinity of its surface is increased to or above the $A_3$ transformation temperature or the temperature of the nonferrous metal shot material is increased to or above the recrystallization temperature. The speed of the shot is reduced upon the collision thereof against the metal shot material by an amount depending upon the hardness of the shot. This speed change is mostly converted to heat energy. Heat exchange takes place only in deformed portions of the metal shot material against which the shot has collided. Accordingly, the temperature increase is limited to the portions of the metal shot material in the vicinity of the surface thereof. Furthermore, the temperature increase is proportional to the speed of the shot before the collision. Accordingly, when the blasting speed is high enough, the increase in the surface temperature of the metal shot material can be made uniform and the surface temperature can be rendered high even if the grain diameter of the shot is 0.3 mm or smaller.

The surface temperature of the shot is also increased as well as that of the metal shot material. When the ferrous metal shot material and shot such as high-speed-steel beads are employed, the temperatures of the metal shot material and the shot are increased to the $A_3$ transformation temperatures of the metal shot material and the base metal of the shot, respectively. Since the temperature increase is limited to the portions of the metal shot material and the shot in the vicinity of the respective surface layers, the metal shot material and the shot are quickly cooled thereafter. Furthermore, a succeeding shot produces the effect of peening and the effect of tempering in the case of a low temperature rise rate or low cooling rate. Consequently, the metallurgical structure of the surface layer 20$\mu$ deep from the surface of the metal shot material is refined such that a highly hardened and tough structure can be obtained.

According to the above-described method, the temperature of the ferrous metal shot material in the vicinity of its surface can be increased to or above the $A_3$ transformation temperature or the temperature of the nonferrous metal shot material can be increased to or above the recrystallization temperature. Consequently, since the surface hardness of the metal shot can be increased, the durability thereof can be improved. Particularly, the surface hardness of the metal shot having a grain diameter of 0.3 mm or smaller can be increased efficiently and reliably although the metal shot cannot be surface-hardened by the prior art heat treatment when the grain diameter thereof is 0.3 mm or smaller.

The above-described method may further comprise the steps of recovering part of the metal shot material and part of the shot blasted against the surface of the metal shot material and reblasting the recovered shot and metal shot material against the surfaces of the unrecovered shot and metal shot material repeatedly. Since the metal shot material and the shot are recovered repeatedly so as to be reblasted against the unrecovered metal shot material and shot, the whole surface of the metal shot material can be heat-treated uniformly, whereupon the durability of the metal shot can be further improved.

The shot may be formed from the same material and have the same grain diameter as the metal shot material. Since the metal shot material and the shot need not be classified after the process of surface hardening, the manufacturing efficiency can be improved.

The shot may be formed from the same material as and have a grain diameter different from the metal shot material. Furthermore, the shot may comprise a metal component which is different from the metal shot material and have the same grain diameter as the metal shot material. Additionally, the shot may comprise a metal component which is different from the metal shot material and have a grain diameter different from that of the metal shot material. In each of the cases, the metal shot material and the shot are classified by a classifier such as a sieve after the surface hardening. Alternatively, the mixture of the metal shot material and the shot may be used as shot when work pieces are to be blasted.

The metal shot material may be composed of a powdered alloy comprising a plurality of kinds of green compacts including a green compact serving as a binding agent and the temperature of the shot in the vicinity of the surface thereof may be increased to or above a recrystallization temperature of the green compact serving as the binding agent.

Alternatively, the metal shot material may be blasted against a metal body having a hardness at least equal to that of the metal shot material. In this case as well, the surface temperature of the metal shot material is increased to at least the $A_3$ transformation temperature thereof when the metal shot material is ferrous and to above the recrystallization temperature thereof when non-ferrous. Thus, the same results as those mentioned above can be achieved.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
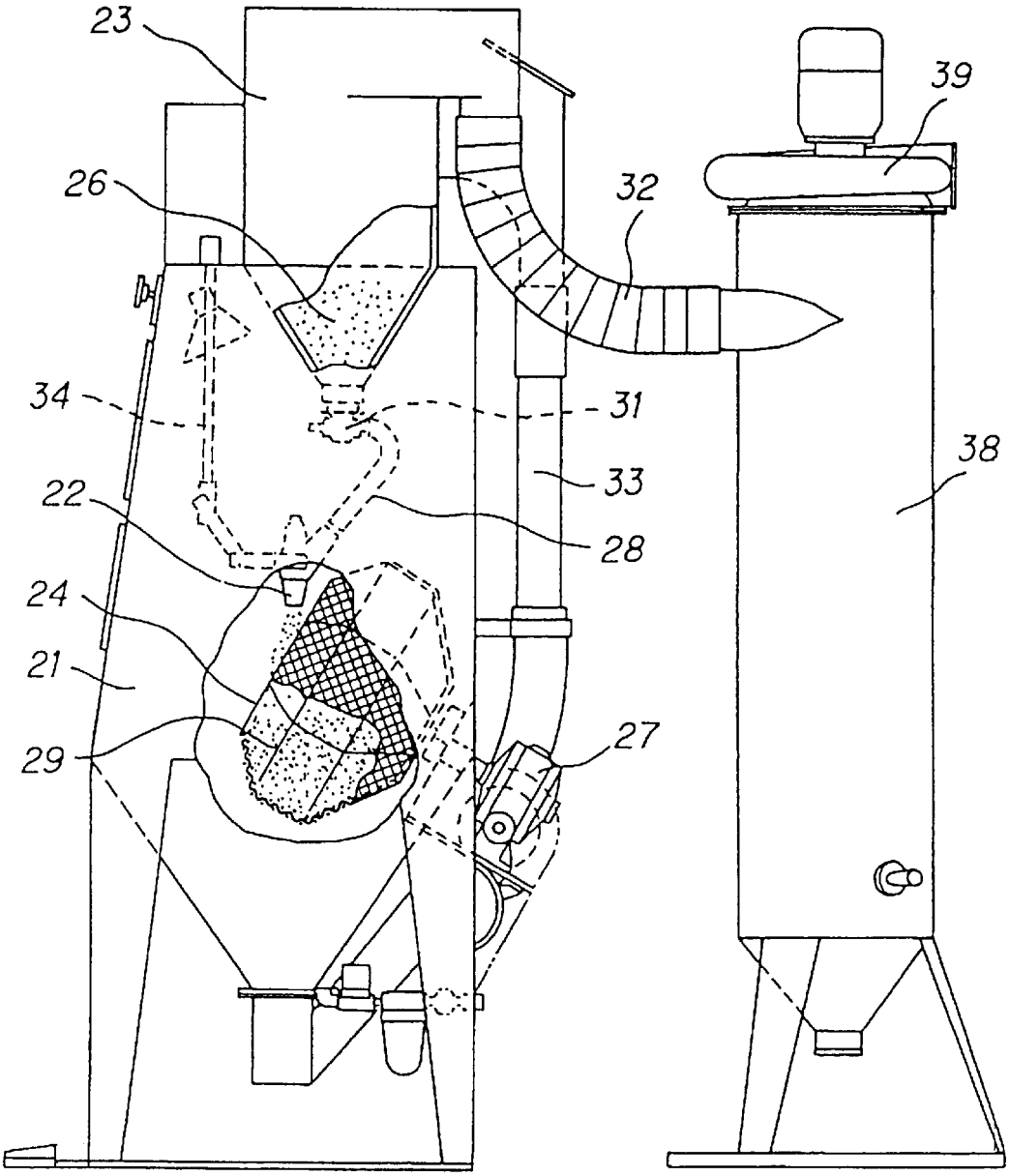
FIG. 1 is a partially broken away front view of a blasting machine for carrying out methods of making metal shot according to the present invention.

Several embodiments of the present invention will be described with reference to the accompanying drawings. Although a pneumatic blasting machine of the gravity type or of the straight hydraulic type is employed in the embodiments, other types of blasting machines may be used.

First Embodiment

A blasting machine comprises a cabinet 21 and a recovery tank 23 which accommodates 10 kg of shot 26. The shot 26 is composed of generally spherical high-speed steel beads each having a hardness of 650 to 750 Hv and a grain diameter of #300 (50$\mu$). Each high-speed steel bead is composed of 1.7%-C, 4.0%-Cr, 2.0%-Mo, 15%-W, 5.0%-V and 8.0%-Co with the remainder being Fe. Note, all examples of the steel given below will omit reference to the iron content of the steel for the sake of simplicity. A barrel 24 is provided in the cabinet 21 for accommodating 10 kg of metal shot material 29 serving as a workpiece to be blasted. The metal shot material 29 is composed of the same material as of the shot 26 and has the same grain diameter as the shot 26. The barrel 24 has an opening so as to constitute a receptacle. The barrel 24 is rotatably mounted in the cabinet 21 so that the opening thereof is directed obliquely upwardly. The blasting machine further includes an electric motor 27 and a speed reduction mechanism (not shown connecting the motor 27 to the barrel 24). The barrel 24 is rotated three turns per minute by the motor 27 via the speed reduction mechanism. The recovery tank 23 is connected at the lower end thereof to a shot quantity adjuster 31, which is further connected to one end of a tube 28. The other end of the tube 28 is connected to a nozzle 22 disposed in the cabinet 21. The nozzle 22 has a diameter of 5 mm.

When compressed air from a compressed air source (not shown) is supplied via a tube 34 to the nozzle 22, the shot 26 accommodated in the recovery tank 23 is fed via the adjuster 31 and the tube 28 to the nozzle 22, from which the shot 26 is blasted against the metal shot material 29 in the barrel 24. The shot 26 blasted from the nozzle 22 collides against the metal shot material 29 in the barrel 24 which is being rotated. The temperatures of the surfaces of the shot 26 and the metal shot material 29 are locally raised to a hardening temperature due to energy generated at the time of collision. Thereafter, the metal shot material 29 is quickly cooled so as to be hardened.

The following TABLE 1 shows the conditions and the results of the blasting in the first embodiment:

TABLE 1

| | |
|---|---|
| Type of the blasting machine | gravity type |
| Blasting pressure | 5 kg/cm$^2$ |
| Blasting speed | 80 m/s or above |
| Nozzle diameter | 5 mm |
| Blasting performance | 5 kg/min. |
| Blasting distance | 200 mm |
| Blasting time | one hour |
| Material of the shot | high-speed steel beads (1.7%-C, 4.0%-Cr, 2.0%-Mo, 15%-W, 5.0%-V and 8.0%-Co) |
| Grain diameter of the shot | 50$\mu$ (#300) |
| Quantity of the shot | 20 kg |
| Material of the metal shot | the same as of the shot |
| Hardness of the metal shot material before blasting | 650 to 750 Hv |
| Hardness of the metal shot material after blasting | 1,000 to 1,100 Hv |

The rise in the temperature of the metal shot material 29 will now be described. The speed of the shot 26 is reduced by the collision thereof against the metal shot material 29, the reduction in speed depending upon the hardness of the shot 26. This speed change is converted mostly to heat energy rather than to sound. The heat energy is considered to be internal friction due to deformation of the collided portions of the metal shot material 29 at the time of collision with the shot 26. Since the heat exchange takes place only in the deformed portions against which the shot 26 has collided, the temperatures of these portions of the metal shot material 29 are rendered higher. That is, the weight of each portion which is deformed by the shot and whose temperature rises is increased in proportion to the speed of the shot before the collision. The temperature rise is limited to the portions in the vicinity of the surface thereof. The restitution coefficient e approximates 1 when the surface temperatures of the shot 26 and the metal shot material 29 are high. Since the deformed portions of the metal shot material are small in this case, the temperatures of the deformed portions are rendered further higher.

Furthermore, the temperature increase is proportional to the speed of the shot 26 before the collision. Accordingly, the blasting speed of the shot 26 needs to be increased. The shot 26 can be blasted at a high speed of 80 m/s or above when the grain diameter ranges between 40 and 200$\mu$. Additionally, the temperature increase in the surface of the metal shot material 29 can be made uniform. The grain diameter should not be limited to the above-described range when the shot can be blasted at a high speed.

An impact of the shot 26 raises the temperature of a surface layer of the metal shot material 29. When the metal shot material 29 is a ferrous material such as high-speed steel beads, the surface temperature is raised to or above an $A_3$ transformation temperature of a base material of the metal shot material 29. However, since the temperature rise is limited to the portion of the material 29 in the vicinity of the surface layer thereof, the material 29 is quickly cooled thereafter.

Furthermore, a succeeding shot 26 produces the effect of peening and the effect of tempering in the case of low temperature rise rate or low cooling rate. Consequently, the metallurgical structure of the surface layer 20$\mu$ deep from the surface of the metal shot material is refined such that a highly hardened and tough structure can be obtained.

Rotation of the barrel 24 agitates the metal shot material 29 and the shot 26 blasted from the nozzle 22. Part of the material 29 and shot 26 overflows the barrel 24, falling down to the lower interior of the cabinet 21. When an exhauster 39 of a dust collector 38 is rotated, pressure is rendered negative in a duct 32, the recovery tank 23, a conduit 33 and the cabinet 21. Accordingly, air is caused to flow from the cabinet 21 to the conduit 33, the recovery tank 23 and the duct 32. The metal shot material 29 and the shot 26 having fallen out of the barrel 24 are conveyed through the conduit 33 communicating with the cabinet 21 into the recovery tank 23 together with dust. The shot 26 and the dust are classified in the recovery tank 23. The classified shot 26 travels to the lower portion of the recovery tank 23 while the dust is fed through the duct 32 connected to the upper portion of the tank 23 into the dust collector 38. The dust is collected at the lower interior of the dust collector 38 and clean air is exhausted out of the exhauster 39.

The shot 26 recovered in the recovery tank 23 is reblasted against the metal shot material 29 in the barrel 24 via the adjuster 31, the tube 28 and the nozzle 22 so that the surfaces of the metal shot material 29 and the shot 26 are hardened. The above-described steps are repeated.

In the above-described blasting method, 5 kg of the shot 26 is blasted from the nozzle 22 per minute and the blasting is performed for about one hour. When 20 kg of shot is accommodated in the blasting machine as described above, the above-described series of steps are repeatedly performed fifteen times during a one-hour blasting. Consequently, the metal shot material is heat-treated substantially over its whole surface and the surface hardness of thereof is increased to 1,000 to 1,100 Hv.

Second Embodiment

In a second embodiment, the shot 26 is composed of steel beads each having a hardness of 600 to 700 Hv and a grain diameter of #300 (50$\mu$). Each steel bead is composed of 0.9 to 1.1%-C, <1.3%-Si and <1.0%-Mn. The metal shot material 29 is surface-treated in the same manner as in the first embodiment. The following TABLE 2 shows the conditions and the results of the blasting in the second embodiment:

TABLE 2

| | |
|---|---|
| Type of the blasting machine | straight hydraulic type |
| Blasting pressure | 5 kg/cm$^2$ |
| Blasting speed | 80 m/s or above |
| Nozzle diameter | 5 mm |
| Blasting performance | 5 kg/min. |
| Blasting distance | 200 mm |
| Blasting time | one hour |
| Material of the shot | steel beads (0.9 to 1.1%-C, <1.3%-Si and <1.0%-Mn) |
| Grain diameter of the shot | 50$\mu$ (#300) |
| Quantity of the shot | 20 kg |
| Material of the metal shot | the same as of the shot |
| Hardness of the metal shot material before blasting | 600 to 700 Hv |
| Hardness of the metal shot material after blasting | 700 to 800 Hv |

Third Embodiment

In a third embodiment, the shot 26 is composed of stainless steel beads each having a hardness of 250 to 350 Hv and a grain diameter of #80 (0.2 mm). Each stainless steel bead is composed of 0.2 to 0.3%-C, <1.3%-Si and <1.0%-Mn, 18 to 20%-Cr and 8 to 10.5%-Ni. The metal shot material 29 is surface-treated in the same manner as in the first embodiment. The following TABLE 3 shows the conditions and the results of the blasting in the third embodiment:

TABLE 3

| | |
|---|---|
| Type of the blasting machine | straight hydraulic type |
| Blasting pressure | 5 kg/cm$^2$ |
| Blasting speed | 80 m/s or above |
| Nozzle diameter | 5 mm |
| Blasting performance | 5 kg/min. |
| Blasting distance | 200 mm |
| Blasting time | one hour |
| Material of the shot | stainless steel beads (0.2 to 0.3%-C., <1.3%-Si, <1.0%-Mn, 18 to 20%-Cr and 8 to 10.5%-Ni) |
| Grain diameter of the shot | 0.2 mm (#80) |
| Quantity of the shot | 20 kg |
| Material of the metal shot | the same as of the shot |
| Hardness of the metal shot material before blasting | 250 to 350 Hv |
| Hardness of the metal shot material after blasting | 450 to 550 Hv |

Fourth Embodiment

In a fourth embodiment, the shot 26 is composed of high-speed steel beads each having a hardness of 650 to 750 Hv and a grain diameter of #300 (50$\mu$). Each high-speed steel bead is composed of 1.3%-C, 4.0%-Cr, 5.0%-Mo, 6.0%-W, 3.0%-V and 8.0%-Co. The metal shot material 29 is surface-treated in the same manner as in the first embodiment. The following TABLE 4 shows the conditions and the results of the blasting in the fourth embodiment:

TABLE 4

| | |
|---|---|
| Type of the blasting machine | straight hydraulic type |
| Blasting pressure | 5 kg/cm$^2$ |
| Blasting speed | 80 m/s or above |
| Nozzle diameter | 5 mm |
| Blasting performance | 5 kg/min. |
| Blasting distance | 200 mm |
| Blasting time | one hour |
| Material of the shot | high-speed steel beads (1.3%-C, 4.0%-Cr, 5.0%-Mo, 6.0%-W, 3.0%-V and 8.0%-Co) |
| Grain diameter of the shot | 50$\mu$ (#300) |
| Quantity of the shot | 20 kg |
| Material of the metal shot | the same as of the shot |
| Hardness of the metal shot material before blasting | 650 to 750 Hv |
| Hardness of the metal shot material after blasting | 900 to 1,000 Hv |

Fifth Embodiment

In a fifth embodiment, the metal shot material is a nonferrous metal material. More specifically, the metal shot material is composed of pieces of an aluminum alloy wire each having a diameter of 0.4 mm, a length of 0.4 mm and a hardness of 80 to 100 Hv. Each piece of aluminum alloy wire is composed of <0.1%-Zn, <0.1%-Cr, <0.1%-Cu, <0.3%-Si, <0.4%-Fs, 0.1%-Mn, and 5%-Mg with Al constituting the remainder. The aluminum alloy wire is surface-treated in the same manner as in the first embodiment. The aluminum alloy wire pieces are blasted against the surface of a steel sheet of SKD 11 having a hardness of 700 Hv. The following TABLE 5 shows the conditions and the results of the blasting in the fifth embodiment:

TABLE 5

| | |
|---|---|
| Type of the blasting machine | straight hydraulic type |
| Blasting pressure | 4 kg/cm$^2$ |
| Blasting speed | 80 m/s or above |
| Nozzle diameter | 9 mm |
| Blasting performance | 8 kg/min. |
| Blasting distance | 200 mm |
| Blasting time | one hour (The wire pieces became spherical after one hour.) |
| Material of the metal shot | aluminum alloy cut wire <0.1%-Zn, <0.1%-Cr, <0.1%-Cu, <0.3%-Si, <0.4%-Fs, 0.1%-Mn, 5%-Mg and Al (remainder) |
| Grain diameter of the metal shot material | the diameter of 0.4 mm and the length of 0.4 mm |
| Quantity of the metal shot material | 20 kg |
| Object against which the metal shot material is blasted | steel sheet of SKD 11 with HRC 60 (700 Hv) |
| Hardness of the metal shot material before blasting | 80 to 100 Hv |
| Hardness of the metal shot material after blasting | 150 to 200 Hv |

Sixth Embodiment

In a sixth embodiment, too, the metal shot material is a nonferrous metal material. A copper alloy is employed as the metal shot material and has a hardness of 650 to 750 Hv and is composed of 17%-Ni, 20%-Zn, 0.4%-Mn, 0.04%-Fe and Cu (remainder). The metal shot material is surface-treated in the same manner as in the first embodiment. The metal shot material is blasted against the surface of a steel sheet of SKD 11 having a hardness of 700 Hv. The following TABLE 6 shows the conditions and the results of the blasting in the sixth embodiment:

TABLE 6

| | |
|---|---|
| Type of the blasting machine | gravity type |
| Blasting pressure | 5 kg/cm$^2$ |
| Blasting speed | 140 m/s or above |
| Nozzle diameter | 9 mm |
| Blasting performance | 3 kg/min. |
| Blasting distance | 200 mm |
| Blasting time | two hours |
| Material of the metal shot | copper alloy specific gravity: 8.5 (17%-Ni, 20%-Zn, 0.4%-Mn, 0.04%-Fe and Cu (remainder) |
| Grain diameter of the metal shot material | 50$\mu$ (#300) |
| Quantity of the metal shot | 29 kg material |
| Object against which the metal shot material is blasted | steel sheet of SKD 11 with HRC 60 (700 Hv) |
| Hardness of the metal shot material before blasting | 160 to 200 Hv |
| Hardness of the metal shot material after blasting | 250 to 300 Hv |

The aluminum alloy wire pieces employed as the shot in the fifth embodiment each have a diameter of 0.4 mm and a length of 0.4 mm. Although the shot has a relatively large diameter, the surface hardness thereof is increased from the range of 80 to 100 Hv to the range of 150 to 200 Hv. Consequently, the ordinary hardening and tempering conventionally performed are not necessary in the fifth embodiment. In the sixth embodiment, the copper alloy having a grain diameter of 0.3 mm or below is employed as the shot. Although the shot has a relatively small diameter and is formed from a nonferrous metal, sufficient surface hardening can be achieved in the sixth embodiment. Thus, the method of the present invention can achieve desirable results with respect to nonferrous metal shot having small and large diameters. Furthermore, in each of the fifth and sixth embodiments, a steel sheet having a high hardness is employed as the object against which the shot 26 is blasted. The shot 26 can be sufficiently surface-treated in each embodiment.

The metal shots made in accordance with the method of the present invention were compared with prior art metal shots. In the comparison, these metal shots were used for the blasting of metal products. The metal shots made in accordance with the method of the present invention will be referred to as "present metal shots." The following TABLE 7 shows the conditions of the blasting common to the present and prior art metal shots:

TABLE 7

| | |
|---|---|
| Type of the blasting machine | straight hydraulic type |
| Name of the metal product | cemented gear (external diameter: ϕ50) |
| Material of the product | SCM420 (chrome-molybdenum steel) |
| Surface hardness of the product | 700 Hv |
| Diameter of the nozzle | 5 mm (Metal shots are blasted from three nozzles at 30° to the tooth flank of the cemented gear.) |
| Blasting distance | 150 mm |
| Treating time | 60 sec. per product |
| Grain diameter of metal shot | 50μ (#300) |

The following TABLE 8 shows the conditions of the blasting different between the present metal shots and the prior art metal shot. A present shot X differs from a present shot A in the material and the hardness.

TABLE 8

| | Prior art shot A | Present shot A | Present shot X |
|---|---|---|---|
| Material | steel beads | steel beads | high-speed steel beads |
| Hardness | 600 to 700 Hv | 700 to 800 Hv | 900 to 1,000 Hv |
| Blasting pressure | 5 kg/cm$^2$ | 4 kg/cm$^2$ | 3.5 kg/cm$^2$ |
| Blasting speed | 200 m/s | 180 m/s | 150 m/s |
| Product's Surface stress | 1,500 MPa | 1,500 MPa | 1,500 MPa |
| Product's surface structure | martensite | martensite | martensite |
| Product's surface hardness | 1,000 Hv | 1,000 Hv | 1,000 Hv |
| Product's arc height | 0.16 N | 0.16 N | 0.16 N |
| Consumed quantity of the shot | 1 | ⅓ | ¼ |

As is obvious from TABLES 7 and 8, even when the blasting pressure is rendered lower in the present shot A than in the prior art shot A, the stress of the treated surface, the surface structure, the surface hardness of the product in the case of the present shot A are equal to those in the case of the prior art shot A. Furthermore, the consumed quantity of the shot in the present shot A is one third of that in the prior art shot A. The consumed quantity of the shot refers to the grams of shot consumed during one hour's operation of a single nozzle. Consequently, the durability of the metal shot surface-treated by the method of the present invention can be improved and stable surface-hardening can be applied to the surface of the metal shot material by the method of the present invention.

The present shot X differs from the prior art shot A and the present shot A in the material. Since the hardness of the shot is higher in the present shot X than in the present shot A, the stress of the treated surface, the surface structure, the surface hardness of the product in the case of the present shot X are equal to those in the case of the prior art shot A even when the blasting speed is rendered lower in the present shot X than in the present shot A. Furthermore, the consumed quantity of the shot in the present shot X is one fourth of that in the prior shot A and smaller than in the present shot A. TABLES 7 and 8 show that the life of the shot can be improved as the hardness thereof is increased. Thus, the surface hardness of the shot having a large diameter can be efficiently improved in the method of the present invention. Furthermore, the surface hardness of the shot having a small diameter in particular can be improved in the method of the present invention although improvement in the surface hardness of the shot having a small diameter is difficult in the prior art heat treatment.

TABLES 9 and 10 show another example of comparison. A present shot B and a prior art shot B differ from the present shot A and the prior shot A in the foregoing comparison respectively. TABLE 9 shows the conditions of the blasting common to the present and prior art metal shots:

TABLE 9

| | |
|---|---|
| Type of the blasting machine | straight hydraulic type |
| Name of the metal product | cemented gear (external diameter: ϕ60) |
| Material of the product | SNCM420 (nickel-chrome-molybdenum steel) |
| Surface hardness of the product | 700 Hv |
| Diameter of the nozzle | 5 mm (Metal shots are blasted from three nozzles at 30° to the tooth flank of the cemented gear.) |
| Blasting distance | 150 mm |
| Treating time | 100 sec. per product |
| Grain diameter of metal shot | 0.2 mm (#80) |

The following TABLE 10 shows the conditions of the blasting different between the present metal shot and the prior art metal shot:

TABLE 10

| | Prior art shot B | Present shot B |
|---|---|---|
| Material | steel beads | steel beads |
| Hardness | 600 to 700 Hv | 1,000 to 1,100 Hv |
| Blasting pressure | 5 kg/cm$^2$ | 3 kg/cm$^2$ |
| Blasting speed | 150 m/s | 110 m/s |
| Product's Surface stress | 1,300 MPa | 1,300 MPa |
| Product's surface structure | martensite | martensite |
| Product's surface hardness | 1,000 Hv | 1,000 Hv |
| Product's arc height | 0.16 A | 0.16 A |
| Consumed quantity of the shot | 1 | ⅕ |

As is obvious from TABLES 9 and 10, even when the blasting pressure is rendered lower in the present shot B than in the prior art shot B as in the foregoing example, the stress of the treated surface, the surface structure, the surface hardness of the product in the case of the present shot B are equal to those in the case of the prior art shot B.

Furthermore, the consumed quantity of the shot in the present shot B is one fifth of that in the prior art shot B. Consequently, the durability of the metal shot surface-treated by the method of the present invention can be improved and stable surface-hardening can be applied to the surface of the metal shot material by the method of the present invention although the present shot B has a small diameter.

TABLES 11 and 12 show still another example of comparison. A present shot C and a prior art shot C differ from the present shots A and B and the prior art shots A and B in the foregoing examples of comparison respectively. In this example, a shaft is employed as the metal product. TABLE 11 shows the conditions of the blasting common to the present and prior art metal shots:

TABLE 11

| | |
|---|---|
| Type of the blasting machine | straight hydraulic type |
| Name of the metal product | cemented gear (external diameter of φ15 and length of 100 mm) |
| Material of the product | SUS304 (stainless steel) |
| Surface hardness of the product | 350 Hv |
| Diameter of the nozzle | 5 mm; only one nozzle used |
| Blasting distance | 150 mm |
| Treating time | 30 sec. per product |
| Grain diameter of metal shot | 0.2 mm (#80) |

The following TABLE 12 shows the conditions of the blasting different between the present metal shot and the prior art metal shot:

TABLE 12

| | Prior art shot C | Present shot C |
|---|---|---|
| Material | stainless steel beads | stainless steel beads |
| Hardness | 250 to 350 Hv | 450 to 550 Hv |
| Blasting pressure | 4 kg/cm$^2$ | 3 kg/cm$^2$ |
| Blasting speed | 130 m/s | 110 m/s |
| Product's Surface stress | 800 MPa | 800 MPa |
| Product's surface structure | martensite | martensite |
| Product's surface hardness | 500 Hv | 500 Hv |
| Product's arc height | 0.10 N | 0.10 N |
| Consumed quantity of the shot | 1 | ½ |

As is obvious from TABLES 11 and 12, even when the blasting pressure is rendered lower in the present shot C than in the prior art shot C as in the foregoing examples, the stress of the treated surface, the surface structure, and the surface hardness of the product in the present shot C are equal to those in the case of the prior art shot C. Furthermore, the consumed quantity of the shot in the present shot C is one half of that in the prior art shot C. Consequently, the durability of the metal shot surface-treated by the method of the present invention can be improved and stable surface-hardening can be applied to the surface of the metal shot material by the method of the present invention although the present shot C has a small diameter.

Figure 2:
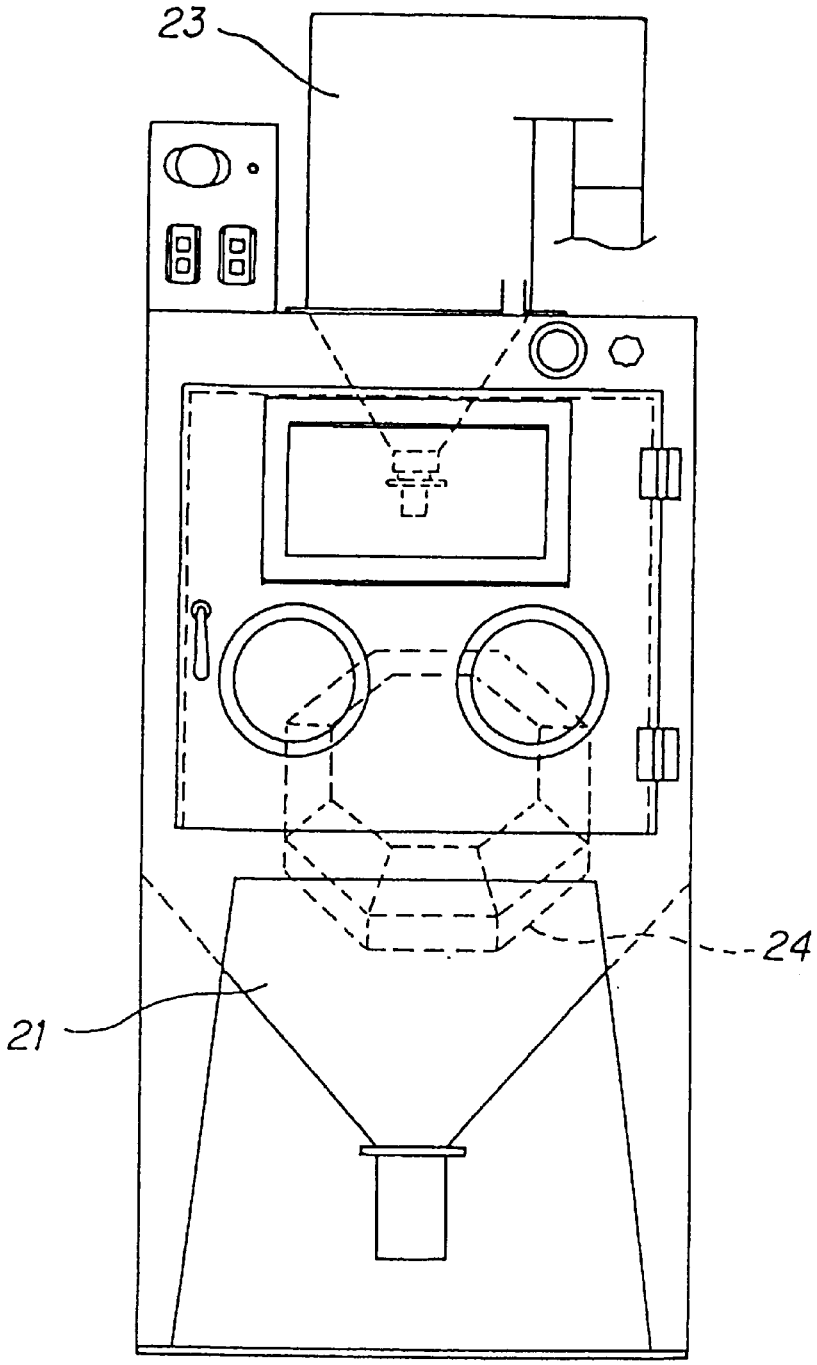
FIG. 2 is a side view of the blasting machine.

The foregoing description and drawings are merely illustrative of the principles of the present invention and are not to be construed in a limiting sense. Various changes and modifications will become apparent to those of ordinary skill in the art. For instance, the metal shot material, be it ferrous or non-ferrous, can be blasted against a metal body/bodies having a hardness at least equal to that of the metal shot material. In this case, the metal shot material may be provided in the first container of a blasting machine similar to that shown in FIGS. 1 and 2. A metal body or bodies such as gears (simply referred to hereinafter as body) is/are provided in the second container. The metal shot material is blasted against the metal body under such conditions, e.g. at a blasting speed of at least 80 m/s and under the other conditions set out in the examples above, that the surface temperature of the metal shot material itself is increased. When the metal shot material is ferrous, the blasting conditions are set to increase the temperature of the shot material at its surface to above the $A_3$ transformation temperature of the metal shot material. In the case when the shot material is non-ferrous, the temperature at the surface of the non-ferrous shot material increases to above the recrystallization temperature of the material or a constituent, such as a binding agent, thereof. Accordingly, the metal shot material becomes a surface-hardened shot product. All such changes and modifications are seen to fall within the true spirit and scope of the invention as defined by the appended claims.

What is claimed is:

1. A method of making surface-hardened metal shot, said method comprising:

accommodating a predetermined quantity of shot in a first container of a blasting machine;

accommodating a predetermined quantity of ferrous metal shot material in a second container of the blasting machine, the shot having a hardness that is at least equal to that of the ferrous metal shot material; and blasting the shot accommodated in the first container against the ferrous metal shot material accommodated in the second container at a speed sufficient to increase the temperature of the ferrous metal shot material in the vicinity of the surface thereof to at least an $A_3$ transformation temperature of the ferrous metal shot material so as to harden the ferrous metal shot material and form surface-hardened metal shot.

2. The method according to claim 1, wherein the shot is of the same material and has the same grain diameter as the ferrous metal shot material.

3. The method according to claim 1, wherein the shot is of the same material as and has a grain diameter different from the ferrous metal shot material.

4. The method according to claim 1, wherein the shot comprises a metal which is different from the ferrous metal shot material and has the same grain diameter as the metal shot material.

5. The method according to claim 1, wherein the shot comprises a metal which is different from the ferrous metal shot material and has a grain diameter different from that of the ferrous metal shot material.

6. The method according to claim 1, wherein each of the ferrous metal shot material and the shot has a grain diameter of 0.3 mm or smaller.

7. The method according to claim 1, and further comprising agitating the ferrous metal shot material during said blasting.

8. The method according to claim 1, and further comprising recovering part of the ferrous metal shot material and part of the shot blasted against the ferrous metal shot material; and blasting the recovered shot and metal shot material against the unrecovered shot and ferrous metal shot material repeatedly.

9. The method of claim 1, wherein said step of blasting comprises blasting the shot against the ferrous metal shot material while the ferrous metal shot material is accommodated in the second container, the second container having an opening therein for receiving the blasted shot therethrough.

10. The method of claim 9, wherein said step of blasting further comprises rotating the second container.

11. The method of claim 9, wherein the first and second containers are accommodated in a cabinet, and further comprising the step of recovering, at a lower portion of said cabinet, shot and ferrous metal shot material that has escaped from the second container during said step of blasting.

12. A method of making surface-hardened metal shot, said method comprising the steps of:

accommodating a predetermined quantity of shot in a first container of a blasting machine;

accommodating a predetermined quantity of non-ferrous metal shot material in a second container of the blasting machine, the shot having a hardness that is at least equal to that of the metal shot material; and blasting the shot accommodated in the first container against the metal shot material accommodated in the second container at a speed sufficient to increase the temperature of the non-ferrous metal shot material in the vicinity of the surface thereof to or above a recrystallization temperature of the non-ferrous metal shot material so as to harden the non-ferrous metal shot material and form surface-hardened metal shot.

13. The method according to claim 12, wherein the shot is of the same material and has the same grain diameter as the metal shot material.

14. The method according to claim 12, wherein the shot is of the same material as and has a grain diameter different from the metal shot material.

15. The method according to claim 12, wherein the shot comprises a metal which is different from the metal shot material and has the same grain diameter as the metal shot material.

16. The method according to claim 12, wherein the shot comprises a metal which is different from the metal shot material and has a grain diameter different from that of the metal shot material.

17. The method according to claim 12, wherein each of the metal shot material and the shot has a grain diameter of 0.3 mm or smaller.

18. The method according to claim 12, and further comprising agitating the metal shot material during said blasting.

19. The method according to claim 12, and further comprising recovering part of the metal shot material and part of the shot blasted against the metal shot material; and blasting the recovered shot and metal shot material against the unrecovered shot and metal shot material repeatedly.

20. The method according to claim 12, wherein the metal shot material is a powdered alloy comprising a plurality of green compacts, one of which is a binding agent, and said blasting increases the temperature of the metal shot material in the vicinity of the surface thereof to at least a recrystallization temperature of the binding agent.

21. A method of making surface-hardened metal shot, said method comprising the steps of:

providing ferrous metal shot material; and blasting the ferrous metal shot material against a metal body having a hardness at least equal to that of the ferrous metal shot material at a speed sufficient to increase the temperature of the ferrous metal shot material in the vicinity of the surface thereof to at least the $A_3$ transformation temperature of the ferrous metal shot material so as to harden the ferrous metal shot material and form surface hardened ferrous metal shot.

22. The method according to claim 21, and further comprising recovering the metal shot material blasted against the surface of the metal body; and reblasting the recovered metal shot material against the surface of the metal body repeatedly.

* * * * *